United States Patent [19]

Frohlich

[11] 3,965,533

[45] June 29, 1976

[54] ADJUSTABLE DOOR SPRING HINGE WITH FIXED MINIMUM TENSION

[75] Inventor: Peter E. Frohlich, Landrum, S.C.

[73] Assignee: Bommer Spring Hinge Co. Inc., Landrum, S.C.

[22] Filed: May 23, 1975

[21] Appl. No.: 580,187

[52] U.S. Cl. ..... 16/189; 16/52; 16/72

[51] Int. Cl.[2] ..... E05F 1/12

[58] Field of Search ..... 16/52, 71, 72, 76, 82, 16/85, 179, 180, 186, 189, 188, 132, 134, 129

[56] References Cited

UNITED STATES PATENTS

| | | | |
|---|---|---|---|
| 3,538,538 | 11/1970 | Field | 16/189 |
| 3,825,973 | 7/1974 | Gwozdz | 16/189 |
| 3,860,993 | 1/1975 | Matuska | 16/52 |

*Primary Examiner*—G. V. Larkin
*Attorney, Agent, or Firm*—Albert F. Kronman

[57] ABSTRACT

Aligned hollow knuckles on a pair of hinge leaves form a cylindrical barrel. Spaced plugs inserted into each end of the barrel serve to keep the knuckles from separating and act as a pivot pin for the hinge. Bifurcated reduced inner portions of the plugs receive the ends of a coil spring therebetween. One plug is permanently secured to a knuckle of one hinge leaf. A pin secured to the other knuckle extends into the barrel and is carried within an annular groove in the adjacent plug. A stop in the groove limits the travel of the pin. Minimum tension is provided at all times in the hinge by the initial setting of the stops with respect to the pin. Additional tension is provided by a plug rotating means together with a second pin engageable with recesses in the plug and a bore in the hinge knuckle.

6 Claims, 4 Drawing Figures

FIG. 1
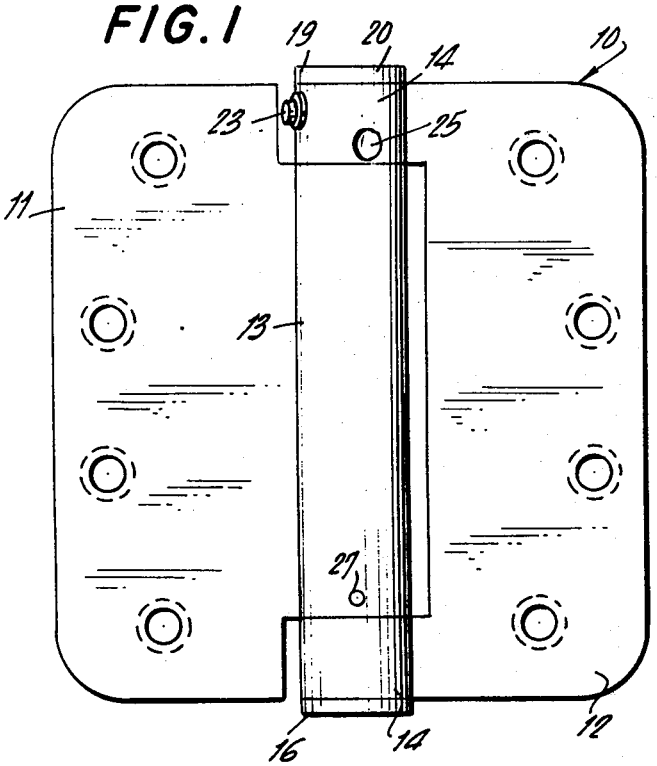
FIG. 2
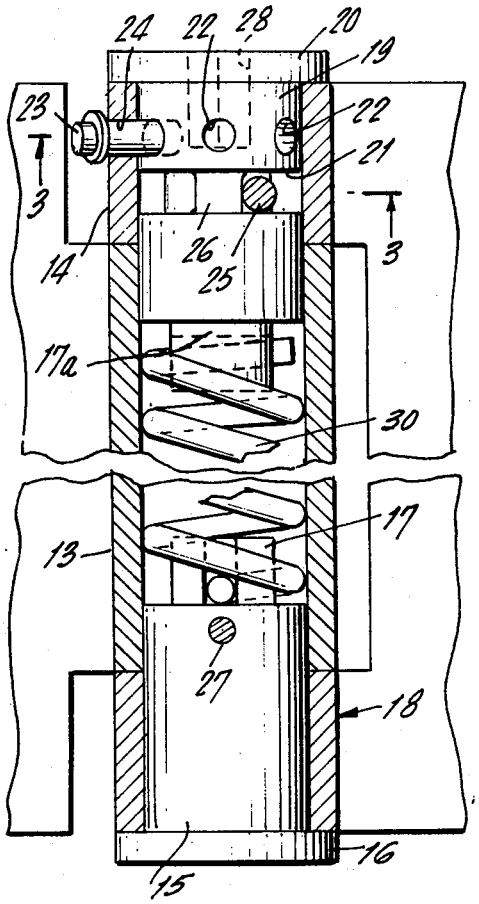
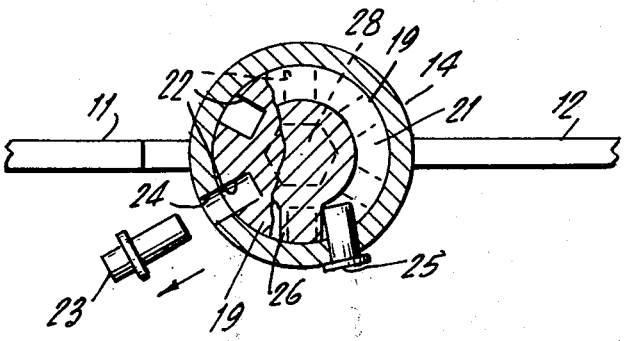
FIG. 3
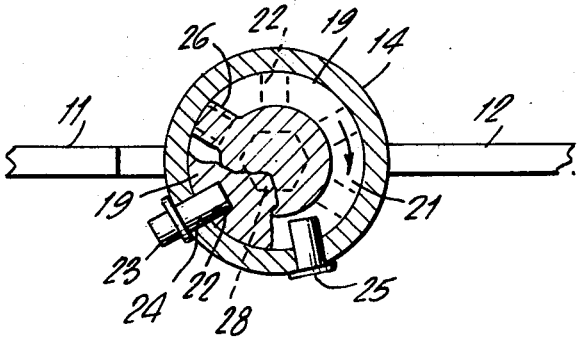
FIG. 4

ADJUSTABLE DOOR SPRING HINGE WITH FIXED MINIMUM TENSION

BACKGROUND OF THE INVENTION

Spring hinges for the purpose of urging doors into a closed position at all times are well-known. Such hinges, however, lose their effectiveness if it is possible to disable the operation of the spring mechanism. Since most prior art spring hinges rely on a small removable pin or screw to connect the spring to the hinge barrel they are often rendered inoperative by careless personnel or because of accidental loss or disengagement of the connecting member.

While a permanent pin could be used to couple the hinge barrel to the spring, it is often necessary to add tension to a spring hinge under certain circumstances such as frictional contact of a carpet, warping of the door, strong wind conditions etc.

Accordingly, it is an object of the present invention to provide a spring hinge for a door having both a fixed minimum tension and adjustability for greater tension.

Another object of the present invention is to provide a highly simplified spring hinge structure.

A further object of the present invention is to provide a spring hinge which can be adjusted with a minimum of difficulty using conventional tools.

A feature of the present invention is its compact construction which makes it possible to install it in the space formerly occupied by a conventional butt hinge.

Another feature of the present invention is its small number of parts.

SUMMARY

In one preferred form of the present invention a spring hinge is formed of flat leaves having hollow knuckles integral therewith which combine to form a cylindrical barrel. Each end of the barrel receives a plug which is pinned to one of the hinge leaf knuckles. A coil spring under tension is secured at each end to the plugs within the barrel. One of the plugs is permanently secured to an adjacent knuckle. The opposite plug is initially rotated so as to impart a minimum spring tension to the hinge. The said plug is adjustably affixed to an adjacent portion of the other hinge knuckle. A pin is permanently affixed to the same knuckle and extends inwardly through the knuckle into an annular groove in the hinge plug. The groove is provided with an internal stop or wall which limits the rotary motion of the plug with respect to the pin.

The minimum tension on the hinge can not be reduced during use but further tension on the spring can be provided by rotating the plug to any one of a series of stations and securing the plug at the selected stations by means of a removable pin carried by the hinge knuckle and receivable within recesses in the plug.

DESCRIPTION OF THE DRAWING

In the accompanying drawing forming part hereof, similar parts have been given identical reference numerals, in which drawings:

FIG. 1 is a view in front elevation of a spring hinge made in accordance with the present invention.

FIG. 2 is a cross sectional view of the hinge barrel somewhat enlarged.

FIG. 3 is a horizontal sectional taken on Line 3—3 in FIG. 2 with the adjusting pin removed.

FIG. 4 is a view similar to FIG. 3 in the assembled condition, showing a position of added spring tension.

GENERAL DESCRIPTION

Referring to the drawings, 10 indicates an adjustable door spring hinge having opposed leaves 11, 12. The leaf 11 is provided with an integral knuckle 13 which is received within spaced knuckles 14 formed on the leaf 12. The knuckles 14 bracket the knuckle 13 in the manner shown in FIG. 1 to form an elongated hollow barrel structure. A plug 15 having a flanged portion 16 on one end and a bifurcated portion 17 at the other end thereof is inserted in one end of the barrel 18 of the hinge. This end is hereinafter referred to as the bottom of the hinge. A second plug 19 having a flanged portion 20 at one end and a reduced bifurcated portion **17*a* at its opposite end is inserted in the top of the barrel 18.**

The plug 19 is provided with an annular groove 21 intermediate the ends thereof but adjacent to the inner wall of the upper knuckle 14. In series of recesses 22 is formed in the body of the plug 19 which are spaced from each other and radially disposed around the plug. An adjusting pin 23, best shown in FIG. 2, is received within a bore 24 in the wall of the knuckle 14 and is of a length which will enable it to engage any one of the recesses 22.

It will be seen from an examination of the drawings that a pin shown as a small rivet 25 is also carried by the wall of the upper knuckle 14 and extends through to the groove 21. The groove 21 is provided with a stop 26 which may be in the form of a small wall of unremoved material (as shown in FIGS. 2 and 3), a pin (not shown), or any other suitable structure. The plug 19 is, therefore, limited in its rotation around the longitudinal axis of the barrel 19 by the pin 25 and the obstructing wall 26.

A coil spring 30 of suitable strength is carried within the barrel 18 between the plugs 15, 19, and is engaged at each end by the bifurcated reduced portions **17, 17*a*, of the plugs 15, 19.**

It will be noted from an examination of FIG. 2 that the plugs 15, 19 are of a length which bridges the knuckles 13, 14, thereby providing a bearing surface upon which the knuckles may rotate.

Fron an examination of the foregoing, the operation of the spring hinge will be apparent as follows:

With the hinge member assembled and before the pins in the knuckles are inserted, the securing pin 27 is slid into the plug 15 by means of bores provided in the knuckle 13 and plug 15. The pin 27 may be in the form of a rivet which is permanently affixed to the knuckle 13. The plug 19 is next rotated by inserting a suitable tool such as a hex wrench (not shown) into a hexagonal recess 28 formed in the top of the plug 19. The plug 19 is rotated sufficiently to impart the desired minimum tension to the spring. The location of the wall 26 is such that when the rivet 25 is inserted through the wall of the knuckle 14 and into the annular groove 21 it will be disposed against one side of the wall 26 in the manner shown in FIG. 3. If minimum tension is all that is desired, the adjusting pin 23 may be slipped into the bore 24 to engage the recess 22 which is in register with the bore 23 at the time. The hinge may then be installed in a door in the well-known manner and put into use.

If it is desired to increase tension of the hinge, a wrench may be slipped into the recess 28 and the adjusting pin 23 pulled out of its bore so that the plug 19 may be rotated to a position such as that indicated in FIG. 4. When the spring 30 has been given the desired torque, the pin 23 is slipped into the bore 24 to engage a recess 22 in register with the bore at that adjustment. The wrench is removed and the spring hinge is then ready for operation.

From the foregoing it will be seen that there has been provided a simply constructed spring hinge capable of adjustment but providing a minimum amount of spring tension at all times.

Having thus fully described the invention what is desired to be secured by Letters Patent is:

1. A spring hinge comprising opposed hinge leaves, a cylindrical barrel open at each end formed of integral hollow knuckles on said hinge leaves, a first plug secured within one end of the cylindrical barrel and secured to the hollow knuckle of one of the hinge leaves adjacent thereto, a second plug adjustably secured within the hollow knuckle of the other hinge leaf, said plugs bridging the knuckles of the hinge leaves at each end of the hinge, an annular groove in the second plug, a stop disposed in the annular groove, a series of recesses radially disposed around the second plug, removable pin means carried within an opening in the knuckle adjacent the second plug and selectively receivable within the plug recesses, a spring carried between the first and second plugs within the barrel and coupled to said plugs and a fixed pin carried by the hollow knuckle adjacent the second plug, extending into the annular groove and disposed in the path of the groove stop.

2. A spring hinge according to claim 1 in which the plugs are of a length which will overlap at least a portion of a knuckle on each of the spring leaves to form a bearing for the axial rotation of said leaves with respect to each other.

3. A spring hinge according to claim 1 in which the plugs are provided with flanged portions on the outer ends thereof and the second plug is formed with a recess to receive a hinge tension adjusting tool therein.

4. A spring hinge according to claim 1 in which each plug is formed with a bifurcated reduced portion on the inner end thereto to engage the ends of the spring.

5. A spring hinge according to claim 1 in which the fixed pin and the stop are arranged for engagement when the second plug is rotated to impart a desired minimum tension to the spring.

6. A spring hinge according to claim 1 in which the stop is a wall integral with the second plug.

* * * * *